US010152017B2

(12) United States Patent
Itabashi

(10) Patent No.: US 10,152,017 B2
(45) Date of Patent: Dec. 11, 2018

(54) DEVELOPING CARTRIDGE

(71) Applicant: BROTHER KOGYO KABUSHIKI KAISHA, Nagoya-shi, Aichi-ken (JP)

(72) Inventor: Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/464,581

(22) Filed: Mar. 21, 2017

(65) Prior Publication Data

US 2017/0336754 A1 Nov. 23, 2017

(30) Foreign Application Priority Data

May 20, 2016 (JP) ..... 2016-101185

(51) Int. Cl.
*G03G 21/16* (2006.01)
*G03G 21/18* (2006.01)

(52) U.S. Cl.
CPC ..... *G03G 21/1647* (2013.01); *G03G 21/1676* (2013.01); *G03G 21/1817* (2013.01); *G03G 21/1896* (2013.01); *G03G 2221/1657* (2013.01)

(58) Field of Classification Search
None
See application file for complete search history.

(56) References Cited

U.S. PATENT DOCUMENTS

2013/0051849 A1 2/2013 Itabashi et al.

FOREIGN PATENT DOCUMENTS

JP 2007-57964 A 3/2007
JP 2013-54058 A 3/2013

*Primary Examiner* — Thomas Giampaolo, II
(74) *Attorney, Agent, or Firm* — Merchant & Gould P.C.

(57) ABSTRACT

A first gear cover has a first cover portion that covers an outer peripheral surface of a joint and that protrudes from a third outer surface in a first direction. A gear rotates about a third axis extending in the first direction by receiving driving force from coupling, and is located at a second outer surface. A second gear cover covers at least part of the gear, and has a second cover portion protruding in the first direction, and is located at the second outer surface. A first protruding portion protrudes from the first cover portion in a second direction, and is located at an opposite side from the developing roller with respect to the joint in the second direction. A second protruding portion protrudes from the second cover portion in the second direction, and is located at a same position as the first protruding portion in the second direction.

19 Claims, 12 Drawing Sheets

DEVELOPING CARTRIDGE

CROSS REFERENCE TO RELATED APPLICATIONS

This application claims priority from Japanese Patent Application No. 2016-101185 filed May 20, 2016. The entire content of the priority application is incorporated herein by reference.

TECHNICAL FIELD

This disclosure relates to a developing cartridge.

BACKGROUND

Conventionally, a developing cartridge detachably mountable on a drum cartridge is known. The developing cartridge includes a developing roller. The drum cartridge includes a photosensitive drum contacted by the developing roller. The developing cartridge is pressed toward the photosensitive drum for suitable contact pressure between the developing roller and the photosensitive drum.

For example, a known developing cartridge includes a frame that accommodates developer and a developing roller supported by one end portion of the frame. The drum cartridge includes a pressing member. The pressing member presses another end portion of the frame of the developing cartridge when the developing cartridge is mounted on the drum cartridge. Thereby, the developing cartridge is pressed toward the photosensitive drum.

SUMMARY

According to one aspect, this specification discloses a developing cartridge. The developing cartridge includes a developing roller, a frame, a coupling, a first gear cover, a gear, a second gear cover, a first protruding portion, and a second protruding portion. The developing roller is configured to be rotatable about a first axis extending in a first direction. The frame is configured to accommodate developer, the frame having a one end portion and an other end portion away from the one end portion in a second direction intersecting the first direction. The frame has a first outer surface and a second outer surface at both ends of the frame in the first direction. The second outer surface is located at an opposite side from the first outer surface in the first direction. The coupling is configured to be rotatable about a second axis extending in the first direction, the coupling being located at the first outer surface. The coupling has a joint extending in the first direction. The coupling has a coupling gear that rotates together with the joint. The first gear cover is configured to cover at least part of the coupling gear. The first gear cover is located at the first outer surface. The first gear cover has a third outer surface that is located at an opposite side from the first outer surface with respect to the coupling gear in the first direction. The first gear cover has a first cover portion that covers an outer peripheral surface of the joint and that protrudes from the third outer surface in the first direction. The gear is configured to be rotatable about a third axis extending in the first direction by receiving driving force transmitted from the coupling. The gear is located at the second outer surface. The second gear cover is configured to cover at least part of the gear. The second gear has a second cover portion protruding in the first direction. The second gear cover is located at the second outer surface. The first protruding portion protrudes from the first cover portion in the second direction. The first protruding portion is located at an opposite side from the developing roller with respect to the joint in the second direction. The second protruding portion protrudes from the second cover portion in the second direction. The second protruding portion is located at a same position as the first protruding portion in the second direction.

BRIEF DESCRIPTION OF THE DRAWINGS

Embodiments in accordance with this disclosure will be described in detail with reference to the following figures wherein.

DETAILED DESCRIPTION

The developing cartridge is driven when driving force from an image forming apparatus is inputted to a coupling, and this causes the developing cartridge to be vibrated. Hence, when the other end portion of the frame away from the coupling is pressed, there is a possibility that, due to vibration of the developing cartridge, the pressing direction by the pressing member becomes unstable.

An example of an objective of this disclosure is to provide a developing cartridge that stably receives pressing force in a direction toward a photosensitive drum.

1. Overview of Developing Cartridge

An overview of a developing cartridge 1 will be described while referring to FIG. 1.

Figure 1:
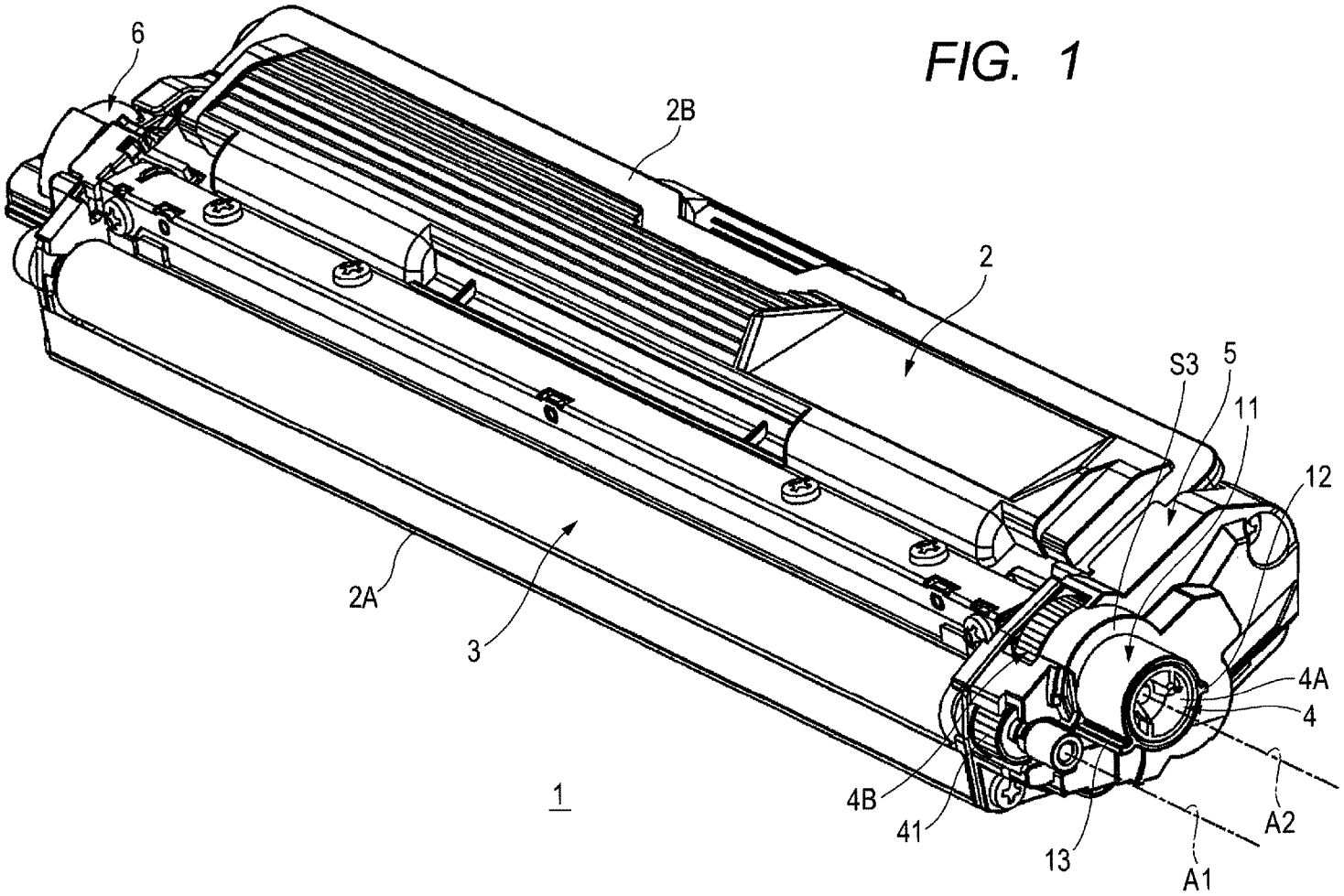
FIG. 1 is a perspective view of a developing cartridge.

As shown in FIG. 1, the developing cartridge 1 includes a frame 2, a developing roller 3, and a coupling 4. The developing roller 3 is rotatable about a first axis A1 extending in a first direction.

1. 1 Frame

The frame 2 extends in the first direction. The frame 2 is configured to accommodate developer. The developer is toner, for example. The frame 2 has a first outer surface S1 (see FIG. 2) and a second outer surface S2 (see FIG. 6) at both ends of the frame 2 in the first direction. The second outer surface S2 is located at the opposite side from the first outer surface S1 in the first direction. The second outer surface S2 is located spaced away from the first outer surface S1 in the first direction. The second outer surface S2 faces the opposite side of the first outer surface S1 in the first direction. The first outer surface S1 and the second outer surface S2 extend in a direction intersecting the first direction. An agitator is provided within the frame 2. The agitator has an agitator shaft 7 exposed to the outside of the frame 2. The frame 2 has a one end portion 2A and an other end portion 2B away from the one end portion 2A in a second direction intersecting the first direction. Specifically, the second direction is a direction connecting the first axis A1 with a second axis A2 described later.

1.2 Developing Roller

The developing roller 3 is located at the one end portion 2A of the frame 2. A part of the circumferential surface of the developing roller 3 is exposed to the outside of the frame 2.

1.3 Coupling

The coupling 4 is located at the first outer surface S1. The coupling 4 is rotatable about the second axis A2 extending in the first direction. The coupling 4 includes a joint 4A and a coupling gear 4B. The joint 4A is a configuration for, when the developing cartridge 1 is mounted on an image forming apparatus, receiving driving force from the image forming apparatus. The joint 4A is located at one end side of the coupling 4 in the first direction. The joint 4A is located at the opposite side from the frame 2 with respect to the coupling gear 4B in the first direction. The joint 4A extends in the first direction. The joint 4A is configured to engage a driving input portion of the image forming apparatus. Engagement of the joint 4A with the driving input portion of the image forming apparatus enables the coupling 4 to receive driving force from the driving input portion of the image forming apparatus. The coupling gear 4B is located between the joint 4A and the frame 2 in the first direction. The coupling gear 4B rotates together with the joint 4A. The coupling gear 4B has a plurality of gear teeth. The plurality of gear teeth is provided on the circumferential surface of the coupling gear 4B.

Figure 2:
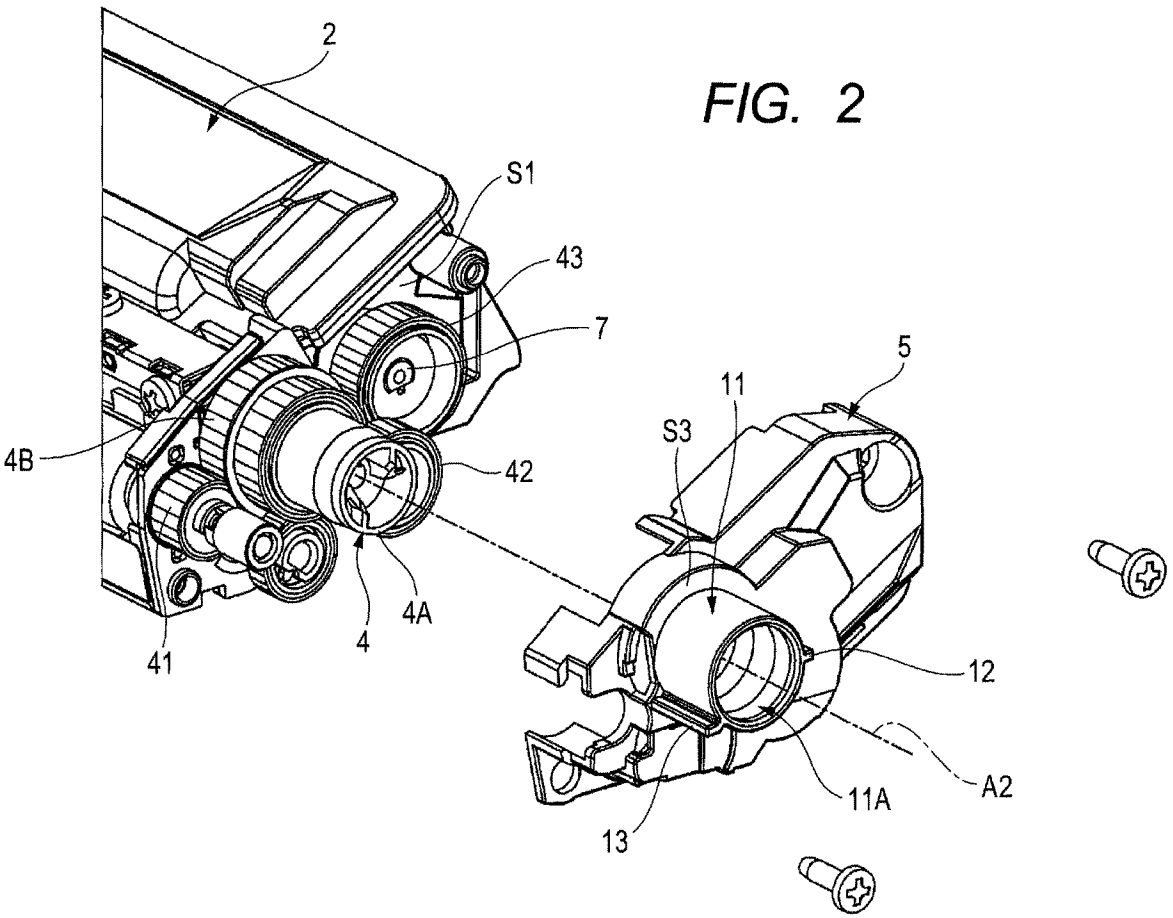
FIG. 2 is a perspective view of the developing cartridge shown in FIG. 1 in a state where a first gear cover is detached.

As shown in FIG. 2, the developing cartridge 1 has a developing gear 41, an idle gear 42, and a first agitator gear 43. The developing gear 41, the idle gear 42, and the first agitator gear 43 are located at the first outer surface S1. The developing gear 41 engages the coupling gear 4B. The developing gear 41 rotates together with the developing roller 3. The developing gear 41 transmits driving force from the coupling gear 4B to the developing roller 3. The idle gear 42 is located spaced away from the developing gear 41 in a rotational direction of the coupling 4. The idle gear 42 engages the coupling gear 4B. The first agitator gear 43 engages the idle gear 42. The first agitator gear 43 rotates together with the agitator. Specifically, the first agitator gear 43 is attached to one end portion of the agitator shaft 7. The idle gear 42 and the first agitator gear 43 transmit driving force from the coupling gear 4B to the agitator.

2. Details of Developing Cartridge

The details of the developing cartridge 1 will be described while referring to FIGS. 1 to 6.

As shown in FIG. 1, the developing cartridge 1 further includes a first gear cover 5 and a second gear cover 6.

2.1 First Gear Cover

Figure 3:
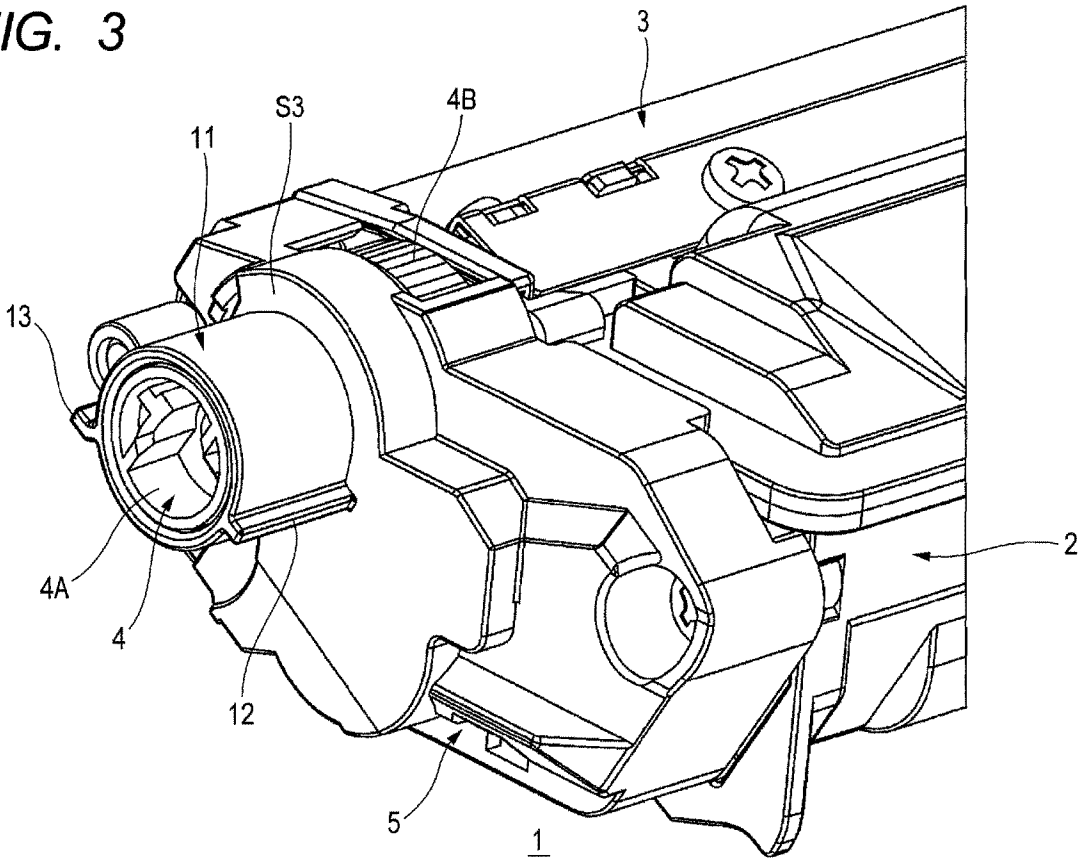
FIG. 3 is a perspective view of the developing cartridge shown in FIG. 1 for particularly showing a one end portion of the developing cartridge in a first direction.

As shown in FIGS. 1, 2 and 3, the first gear cover 5 is located at the first outer surface S1. The first gear cover 5 is a cover for covering the coupling 4, the developing gear 41, the idle gear 42, and the first agitator gear 43. The first gear cover 5 has a third outer surface S3. The third outer surface S3 is located at the opposite side from the first outer surface S1 with respect to the coupling gear 4B in the first direction. That is, the third outer surface S3 of the first gear cover 5 covers at least part of the coupling gear 4B. The third outer surface S3 extends in the second direction. Further, the first gear cover 5 has a first cover portion 11, a first protruding portion 12, and a third protruding portion 13. That is, the developing cartridge 1 has the first protruding portion 12 and the third protruding portion 13.

2.1.1 First Cover Portion

The first cover portion 11 is located at the opposite side from the coupling gear 4B with respect to the third outer surface S3 in the first direction. The first cover portion 11 protrudes from the third outer surface S3 in the first direction. The first cover portion 11 has a cylindrical shape. The first cover portion 11 has a through hole 11A. The through hole 11A is formed through the first cover portion 11 in the first direction. The joint 4A of the coupling 4 fits in the through hole 11A. In a state where the joint 4A fits in the through hole 11A, the first cover portion 11 covers the outer peripheral surface of the joint 4A.

2.1.2 First Protruding Portion and Third Protruding Portion

The first protruding portion 12 and the third protruding portion 13 are located at the outer peripheral surface of the first cover portion 11. The first protruding portion 12 and the third protruding portion 13 are spaced away from each other in the second direction. The first protruding portion 12 is located at the opposite side from the developing roller 3 with respect to the joint 4A in the second direction. The first protruding portion 12 is located closer to the developing roller 3 than the other end portion 2B of the frame 2 is, in the second direction. The third protruding portion 13 is located at the opposite side from the first protruding portion 12 with respect to the joint 4A in the second direction. That is, the first protruding portion 12 is located at the opposite side from the third protruding portion 13 with respect to the second axis A2 in the second direction. The first protruding portion 12 and the third protruding portion 13 protrude from the outer peripheral surface of the first cover portion 11 in the second direction. That is, the first protruding portion 12 and the third protruding portion 13 extend from the first gear cover 5. Here, the first protruding portion 12 and the third protruding portion 13 may be attached to the first gear cover 5. The first protruding portion 12 and the third protruding portion 13 are located at the opposite side from the coupling gear 4B with respect to the third outer surface S3 in the first direction. That is, the first protruding portion 12 is aligned with the coupling gear 4B in the first direction. The first protruding portion 12 and the third protruding portion 13 extend from the third outer surface S3 in the first direction.

Figure 4:
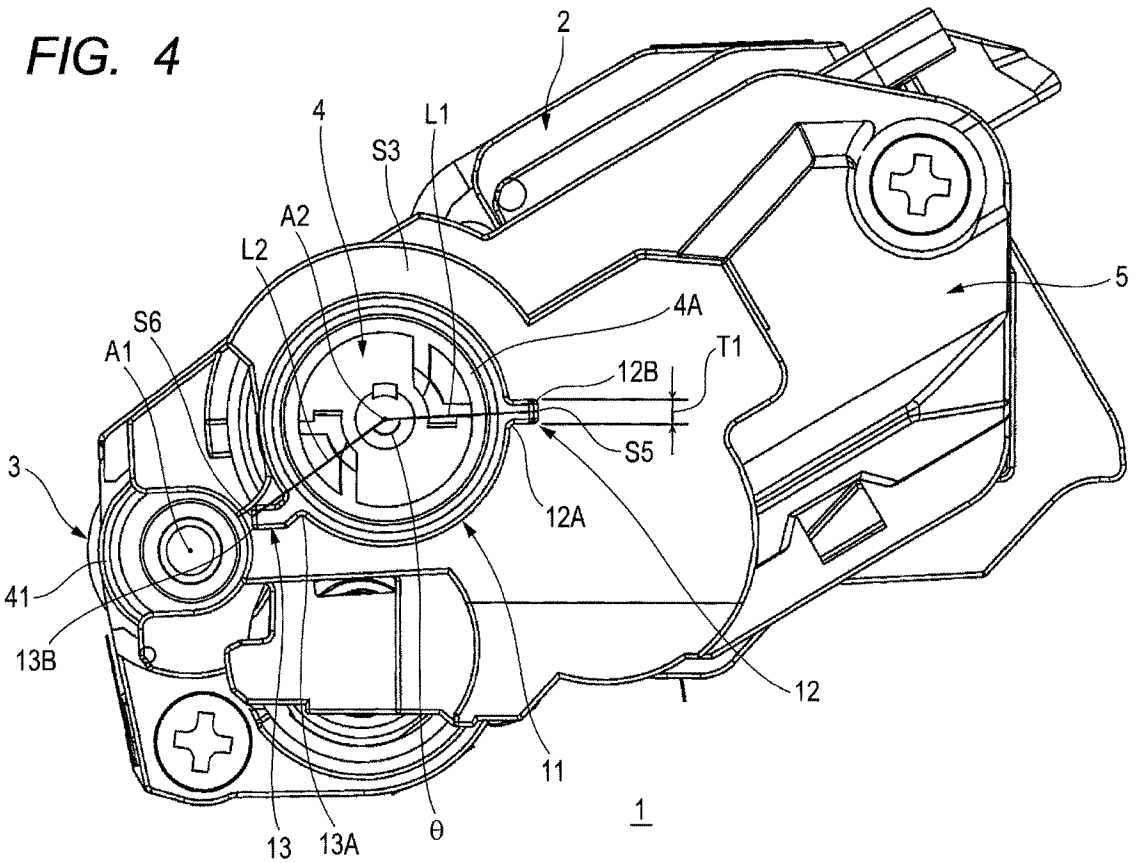
FIG. 4 is a side view of the developing cartridge shown in FIG. 1 for particularly showing the one end portion of the developing cartridge in the first direction.

As shown in FIG. 4, the first protruding portion 12 has a first base end 12A connecting to the first cover portion 11, and a first tip end 12B farthest away from the first base end 12A. The first protruding portion 12 has a flat surface S5. The flat surface S5 is located at the first tip end 12B. The flat surface S5 extends in a direction intersecting an imaginary line L1 connecting the first tip end 12B with the second axis A2. Specifically, the flat surface S5 extends in a direction perpendicular to the imaginary line L1. The length of the first protruding portion 12 in the rotational direction of the coupling 4 is, for example, larger than or equal to 1.0 mm, and preferably larger than or equal to 1.5 mm. Further, from the viewpoint of securing a space for arranging other components, the length of the first protruding portion 12 in the rotational direction of the coupling 4 is, for example, smaller than or equal to 25.0 mm, and preferably smaller than or equal to 20.0 mm. In this embodiment, a length T1 of the first protruding portion 12 in the rotational direction of the coupling 4 is smaller than lengths T2, T3 of first protruding portions 72, 73 in modifications described later, and specifically the length T1 is 1.5 mm, for example. With this configuration, the first protruding portion 12 receives pressing force from a pressing member 33A described later more stably than the first protruding portion 72, 73 in the modifications described later.

The third protruding portion 13 has a second base end 13A connecting to the first cover portion 11, and a second tip end 13B farthest away from the second base end 13A. The length of the third protruding portion 13 from the second base end 13A to the second tip end 13B is larger than the length of the first protruding portion 12 from the first base end 12A to the first tip end 12B. In other words, the length of the first protruding portion 12 from the first base end 12A to the first tip end 12B is smaller than the length of the third protruding portion 13 from the second base end 13A to the second tip end 13B. An angle θ between the imaginary line L1 and an imaginary line L2 connecting the second tip end 13B of the third protruding portion 13 with the second axis A2 is, for example, larger than or equal to 90 degrees, and preferably larger than or equal to 115 degrees. Here, the angle θ is the angle at the supply roller side, that is, the angle θ is the lower angle formed between the imaginary line L1 and the imaginary line L2 shown in FIG. 4. Further, the angle θ is, for example, smaller than or equal to 180 degrees, and preferably smaller than or equal to 145 degrees. The third protruding portion 13 has a flat surface S6. The flat surface S6 is located at the second tip end 13B. The flat surface S6 extends in the same direction as the flat surface S5. Specifically, the flat surface S5 and the flat surface S6 are parallel to each other. In the rotational direction of the coupling 4, the third protruding portion 13 has the same length as the length T1 of the first protruding portion 12.

2.2 Second Gear Cover

Figure 5:
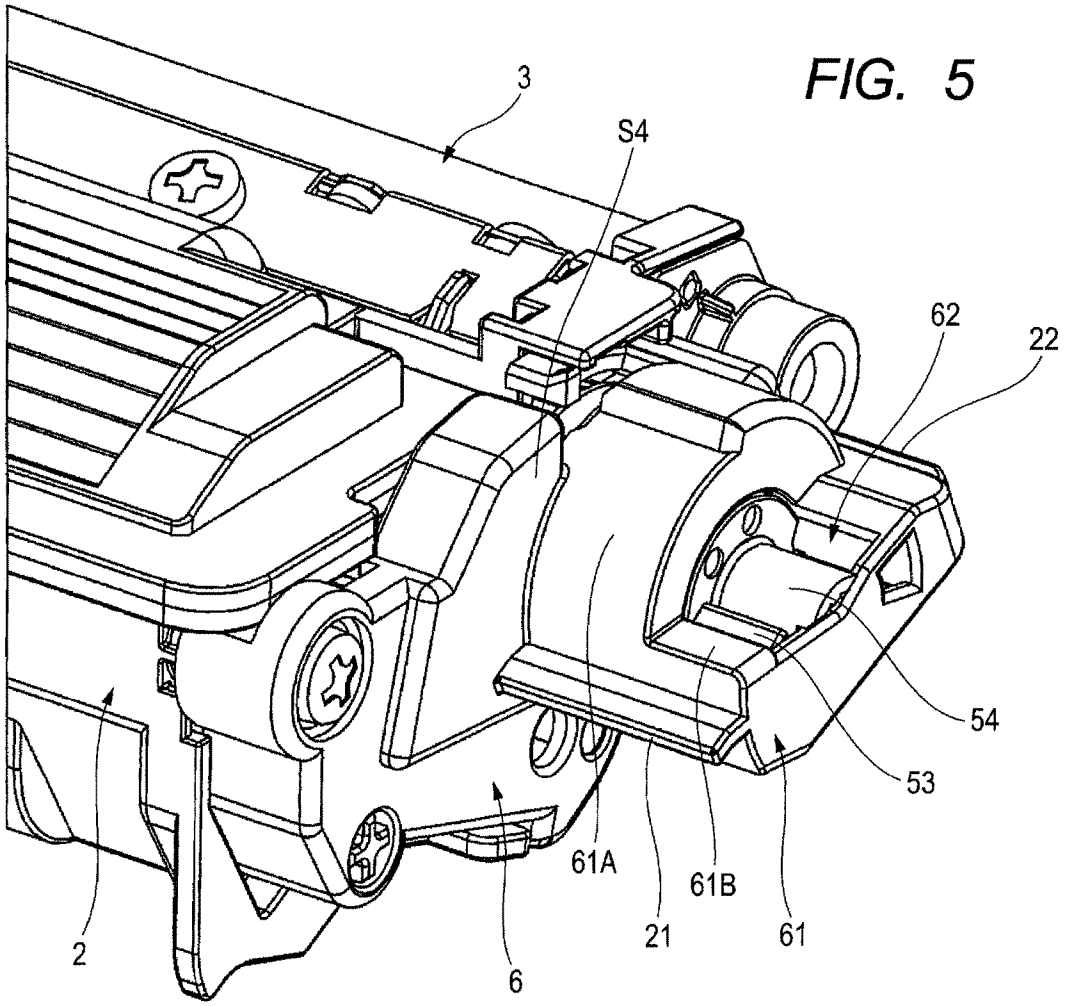
FIG. 5 is a perspective view of the developing cartridge shown in FIG. 1 for particularly showing another end portion of the developing cartridge in the first direction.
Figure 6:
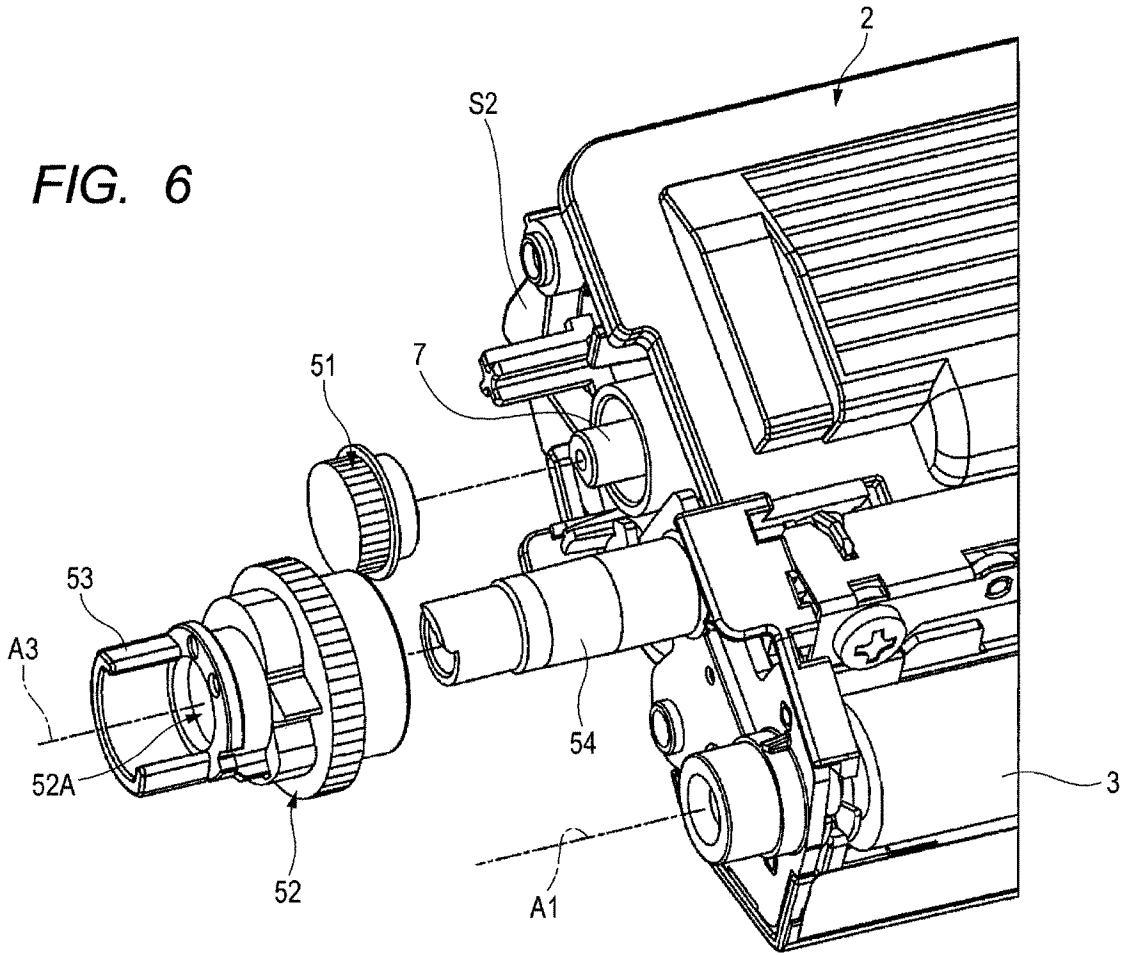
FIG. 6 is a perspective view of the developing cartridge shown in FIG. 1 for particularly showing the other end portion of the developing cartridge in the first direction, in which the other end portion is exploded.

As shown in FIGS. 5 and 6, the developing cartridge 1 further has a second agitator gear 51, a gear 52, and a protrusion 53. The second gear cover 6 is located at the second outer surface S2. The second gear cover 6 is a cover for covering the second agitator gear 51 and the gear 52.

2.2.1 Second Agitator Gear, Gear, and Protrusion

The second agitator gear 51 is located at the second outer surface S2. The second agitator gear 51 rotates together with the agitator. Specifically, the second agitator gear 51 is attached to other end portion of the agitator shaft 7.

The gear 52 is a detection gear. When the developing cartridge 1 is mounted on the image forming apparatus, the gear 52 rotates by receiving driving force transmitted from the coupling 4, thereby rotating the protrusion 53. The gear 52 is located at the second outer surface S2. The gear 52 is located at the opposite side from the coupling 4 (see FIG. 1) with respect to the frame 2 in the first direction. The gear 52 has a through hole 52A. The through hole 52A is formed through the gear 52 in the first direction. A shaft 54 provided at the second outer surface S2 is inserted into the through hole 52A. The shaft 54 extends along a third axis A3 extending in the first direction. The gear 52 is rotatable about the shaft 54. The gear 52 engages the second agitator gear 51. With this configuration, the gear 52 receives, from the second agitator gear 51, driving force transmitted from the coupling 4, and is rotatable about the third axis A3.

When the protrusion 53 rotates together with the gear 52, the protrusion 53 comes outside of the second gear cover 6 through an opening 62 of the second gear cover 6 described later, and is detected by the image forming apparatus. The protrusion 53 is located at the opposite side from the second outer surface S2 with respect to the gear 52 in the first direction. The protrusion 53 is located at the periphery of the through hole 52A. The protrusion 53 extends in the first direction. The protrusion 53 extends from the gear 52 in the first direction. That is, the protrusion 53 is formed integrally with the gear 52. With this configuration, the protrusion 53 is rotatable about the third axis A3, together with the gear 52. Specifically, one protrusion 53 is provided. A plurality of the protrusions 53 may be provided.

2.2.2 Details of Second Gear Cover

The second gear cover 6 has a fourth outer surface S4. The fourth outer surface S4 is located at the opposite side from the first outer surface 51 (see FIG. 2) with respect to the second outer surface S2 in the first direction. The fourth outer surface S4 extends in the second direction. Further, the second gear cover 6 has a second cover portion 61, a second protruding portion 21, and a fourth protruding portion 22. That is, the developing cartridge 1 has the second protruding portion 21 and the fourth protruding portion 22.

The second cover portion 61 is located at the opposite side from the frame 2 with respect to the fourth outer surface S4 in the first direction. The second cover portion 61 protrudes from the fourth outer surface S4 in the first direction. The second cover portion 61 covers the outer peripheral surface of the gear 52. That is, the second gear cover 6 covers at least part of the gear 52. The second cover portion 61 has a cylindrical portion 61A and a protruding portion 61B.

The cylindrical portion 61A is located between the fourth outer surface S4 and the protruding portion 61B in the first direction. The cylindrical portion 61A has a cylindrical shape. That is, the second cover portion 61 has a cylindrical shape. The cylindrical portion 61A extends from the fourth outer surface S4 in the first direction.

The protruding portion 61B is located at the opposite side from the fourth outer surface S4 with respect to the cylindrical portion 61A in the first direction. The protruding portion 61B protrudes from the cylindrical portion 61A in the first direction. The protruding portion 61B extends in the second direction. The protruding portion 61B has the opening 62. The opening 62 is formed through a wall of the protruding portion 61B in a direction intersecting the first direction and the second direction. The protrusion 53 and the shaft 54 are exposed through the opening 62. With this configuration, when the protrusion 53 rotates about the shaft 54, the protrusion 53 once comes outside of the protruding portion 61B through the opening 62, and thereafter goes inside of the protruding portion 61B via the opening 62. Here, when the developing cartridge 1 is mounted on the image forming apparatus, the image forming apparatus detects that the protrusion 53 comes outside of the protruding portion 61B through the opening 62, thereby determining information on the developing cartridge 1. The information on the developing cartridge 1 is, for example, whether the developing cartridge 1 is a new cartridge or not, the amount of stored developer, and so on.

The second protruding portion 21 and the fourth protruding portion 22 are located at the outer peripheral surface of the second cover portion 61. The second protruding portion 21 and the fourth protruding portion 22 are spaced away from each other in the second direction. The second protruding portion 21 is located at the opposite side from the developing roller 3 with respect to the protrusion 53 in the second direction. The second protruding portion 21 is located closer to the developing roller 3 than the other end portion 2B of the frame 2 is in the second direction. The fourth protruding portion 22 is located at the opposite side from the second protruding portion 21 with respect to the protrusion 53 in the second direction. In other words, the second protruding portion 21 is located at the opposite side from the fourth protruding portion 22 with respect to the third axis A3 in the second direction. The second protruding portion 21 and the fourth protruding portion 22 protrude from the outer peripheral surface of the second cover portion 61 in the second direction. That is, the second protruding portion 21 and the fourth protruding portion 22 extend from the second gear cover 6. Here, the second protruding portion 21 and the fourth protruding portion 22 may be attached to the second gear cover 6. Further, the second protruding portion 21 and the fourth protruding portion 22 are located at the opposite side from the frame 2 with respect to the fourth outer surface S4 in the first direction. The second protruding portion 21 and the fourth protruding portion 22 extend from the fourth outer surface S4 in the first direction. The second protruding portion 21 is located at the same position as the first protruding portion 12 in the second direction. The "same position as the first protruding portion 12" denotes a position where the distance between the first axis A1 and the second protruding portion 21 in the second direction is equal to the distance between the first axis A1 and the first protruding portion 12 in the second direction. Here, an error range of a degree of a dimensional tolerance corresponds to the "same position". The fourth protruding portion 22 is located at the same position as the third protruding portion 13 in the second direction. The lengths of the second protruding portion 21 and the fourth protruding portion 22 in the rotational direction of the gear 52 is the same as the length T1 of the first protruding portion 12.

3. Drum Cartridge

The drum cartridge 31 will be described below while referring to FIGS. 7 to 9.

The developing cartridge 1 is detachable on the drum cartridge 31 having the photosensitive drum 32. The photosensitive drum 32 is located at a one end portion of the drum cartridge 31. The photosensitive drum 32 extends in a particular direction.

Figure 7:
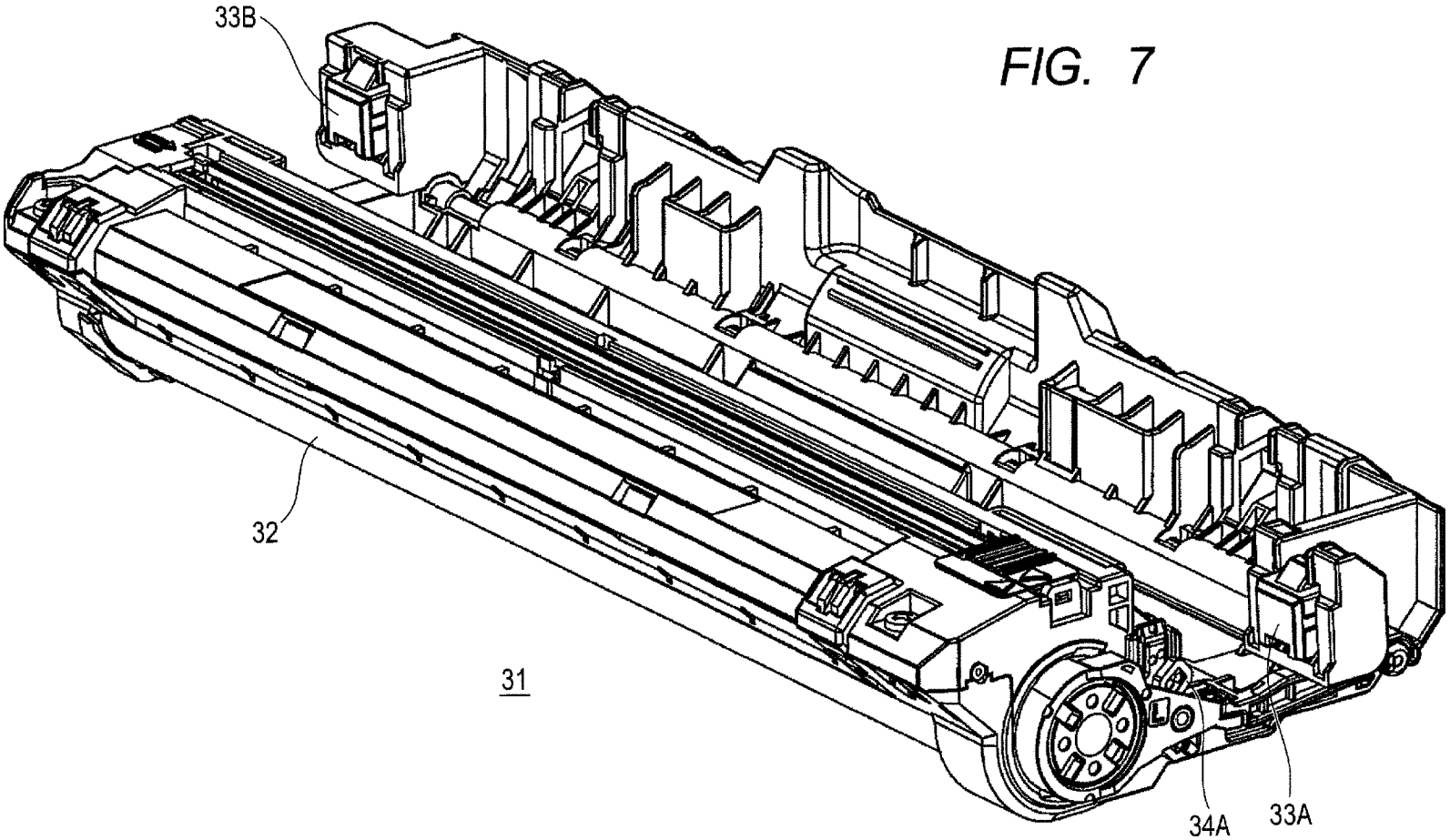
FIG. 7 is a perspective view of a drum cartridge.
Figure 9:
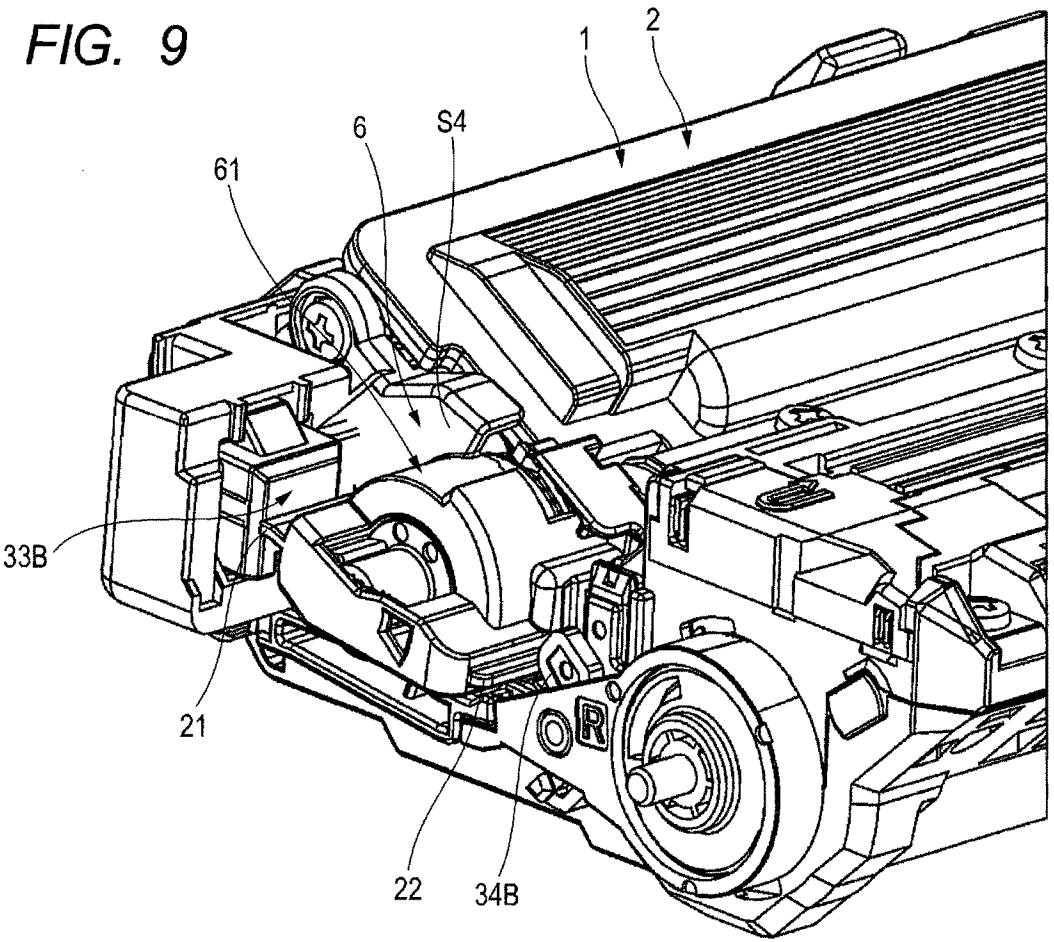
FIG. 9 is an explanatory diagram for illustrating, together with FIG. 8, the state in which the developing cartridge is mounted on the drum cartridge.

As shown in FIG. 7, the drum cartridge 31 includes the pressing member 33A, the pressing member 33B, a separating member 34A, and a separating member 34B (see FIG. 9).

Each of the pressing member 33A and the pressing member 33B is a configuration for pressing the mounted the developing cartridge 1 toward the photosensitive drum 32. The pressing member 33A and the pressing member 33B are located spaced away from each other in the direction in which the photosensitive drum 32 extends. Specifically, the pressing member 33A is located at a side surface of the drum cartridge 31 at one side in the direction in which the photosensitive drum 32 extends. The pressing member 33B is located at a side surface of the drum cartridge 31 at the other side in the direction in which the photosensitive drum 32 extends. Each of the pressing member 33A and the pressing member 33B extends in a direction intersecting the direction in which the photosensitive drum 32 extends. Each of the pressing member 33A and the pressing member 33B has a rectangular tubular shape. Each of the pressing member 33A and the pressing member 33B is pressed toward the photosensitive drum 32 by a compression spring (not shown). As shown in FIG. 8, when the developing cartridge 1 is mounted on the drum cartridge 31, the pressing member 33A presses the first protruding portion 12 of the developing cartridge 1. Specifically, when the developing cartridge 1 is mounted on the drum cartridge 31, the pressing member 33A presses the flat surface S5 (see FIG. 4) of the first protruding portion 12 of the developing cartridge 1. That is, the first protruding portion 12 receives, from the pressing member 33A of the drum cartridge 31, pressing force directed toward the photosensitive drum 32 from the developing roller 3. Further, as shown in FIG. 9, when the developing cartridge 1 is mounted on the drum cartridge 31, the pressing member 33B presses the second protruding portion 21 of the developing cartridge 1. That is, the second protruding portion 21 receives, from the pressing member 33B of the drum cartridge 31, pressing force directed toward the photosensitive drum 32 from the developing roller 3.

Figure 8:
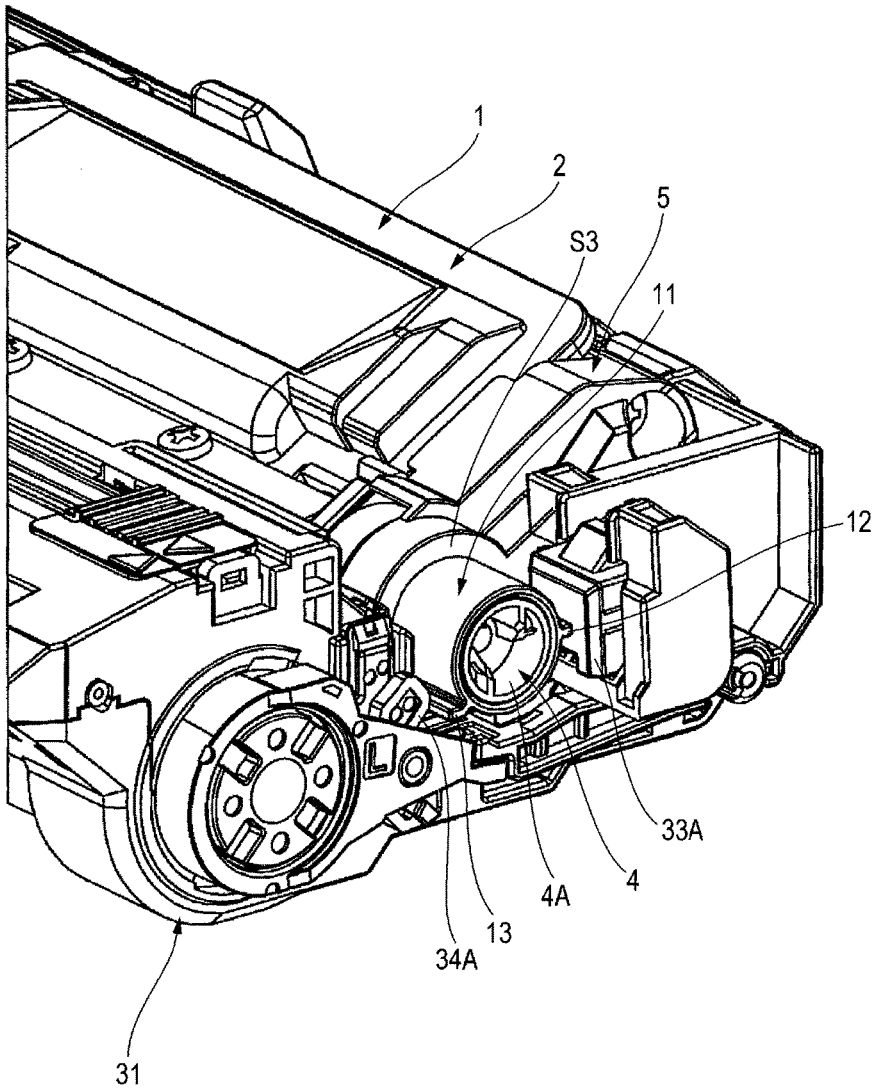
FIG. 8 is an explanatory diagram for illustrating a state in which the developing cartridge is mounted on the drum cartridge.

As shown in FIGS. 8 and 9, each of the separating member 34A and the separating member 34B is a configuration for pressing the mounted developing cartridge 1 in a direction separating from the photosensitive drum 32. For example, when monochromatic printing is performed in a color printer having cyan (C), magenta (M), yellow (Y), and black (K) cartridges, C, M and Y developing cartridges are not necessary. In such case, the separating member 34A and the separating member 34B are used for separating the C, M and Y developing cartridge 1 from the photosensitive drum 32. The separating member 34A and the separating member 34B are located spaced away from each other in the direction in which the photosensitive drum 32 extends. Specifically, the separating member 34A is located at the side surface of the drum cartridge 31 at one side in the direction in which the photosensitive drum 32 extends. The separating member 34A is pivotally supported by the side surface of the drum cartridge 31 at the one side. When the developing cartridge 1 is mounted on the drum cartridge 31, the separating member 34A faces the third protruding portion 13 of the developing cartridge 1. When the developing cartridge 1 and the drum cartridge 31 are mounted on the image forming apparatus and the driving force from a driving source provided in the image forming apparatus is transmitted to the separating member 34A, the separating member 34A pivotally moves and presses the third protruding portion 13 of the developing cartridge 1 in the direction in which the developing roller 3 separates from the photosensitive drum 32. That is, the third protruding portion 13 receives, from the separating member 34A of the drum cartridge 31, the pressing force in the direction in which the developing roller 3 separates from the photosensitive drum 32. The separating member 34B is located at the side surface of the drum cartridge 31 at the other side in the direction in which the photosensitive drum 32 extends. The separating member 34B is pivotally supported by the side surface of the drum cartridge 31 at the other side. When the developing cartridge 1 is mounted on the drum cartridge 31, the separating member 34B faces the fourth protruding portion 22 of the developing cartridge 1. When the developing cartridge 1 and the drum cartridge 31 are mounted on the image forming apparatus and the driving force from the driving source provided in the image forming apparatus is transmitted to the separating member 34B, the separating member 34B pivotally moves and presses the fourth protruding portion 22 of the developing cartridge 1 in the direction in which the developing roller 3 separates from the photosensitive drum 32. That is, the fourth protruding portion 22 receives, from the separating member 34B of the drum cartridge 31, the pressing force in the direction in which the developing roller 3 separates from the photosensitive drum 32.

4. Operations and Effects

According to the developing cartridge 1, as shown in FIG. 3, the first protruding portion 12 protrudes from the first cover portion 11 that covers at least part of the coupling gear 4B. Further, as shown in FIG. 5, the second protruding portion 21 protrudes from the second cover portion 61 of the second gear cover 6.

Hence, as shown in FIGS. 8 and 9, the pressing force directed toward the photosensitive drum 32 is received at a particular position that is closer to the coupling 4 than the other end portion 2B of the frame 2 is, in other words, at the first protruding portion 12 and the second protruding portion 21.

As a result, the developing cartridge 1 stably receives the pressing force directed toward the photosensitive drum 32 at the first protruding portion 12 and the second protruding portion 21.

5. Modification

While the disclosure has been described in detail with reference to the above aspects thereof, it would be apparent to those skilled in the art that various changes and modifications may be made therein without departing from the scope of the claims.

Figure 10:
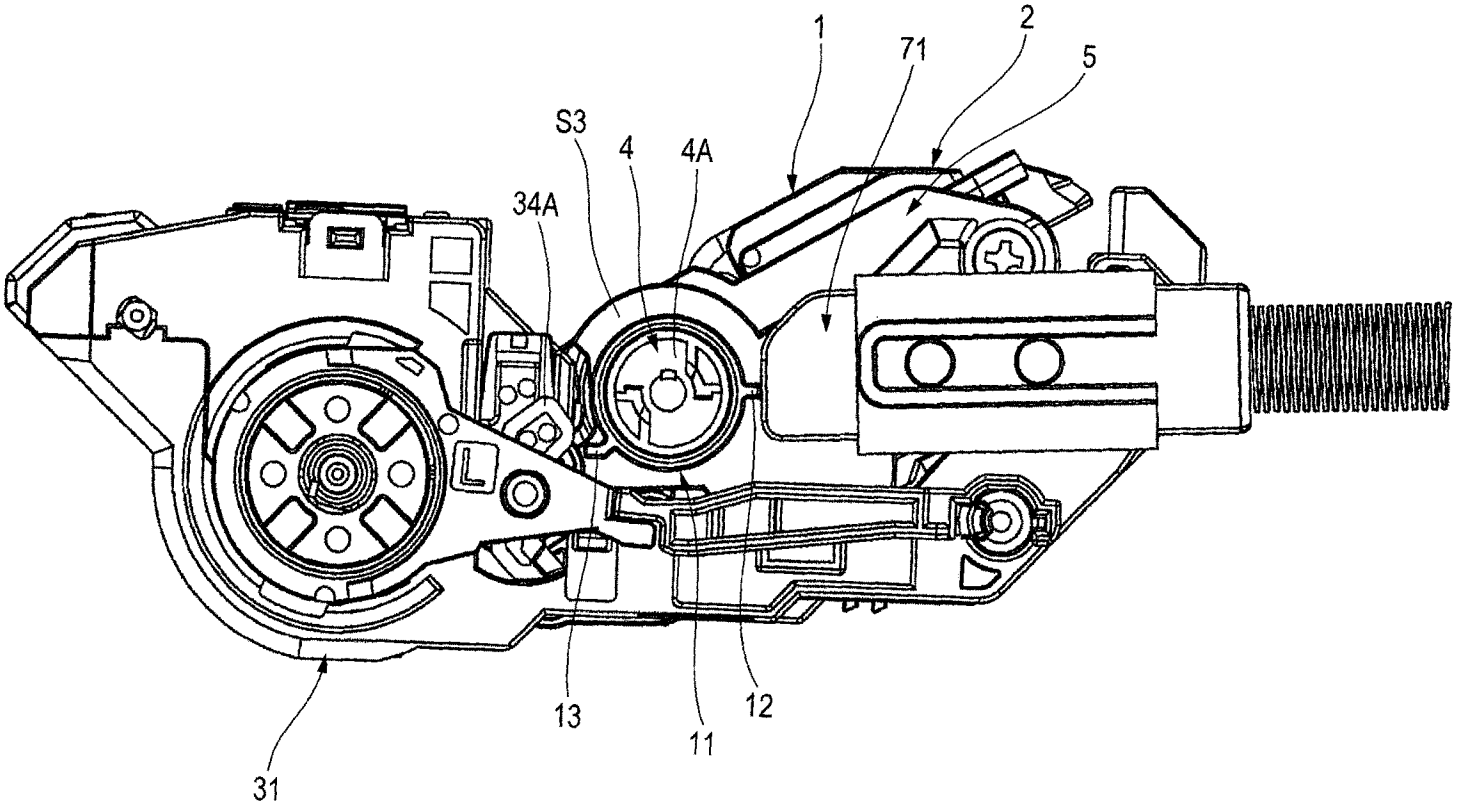
FIG. 10 is an explanatory diagram for illustrating a modification of a pressing member.

For example, the drum cartridge 31 does not necessarily need to have the pressing member 33A and the pressing member 33B. In this case, as shown in FIG. 10, the first protruding portion 12 and the second protruding portion 21 may be pressed by the pressing member 71 provided in an image forming apparatus.

Figure 11A:
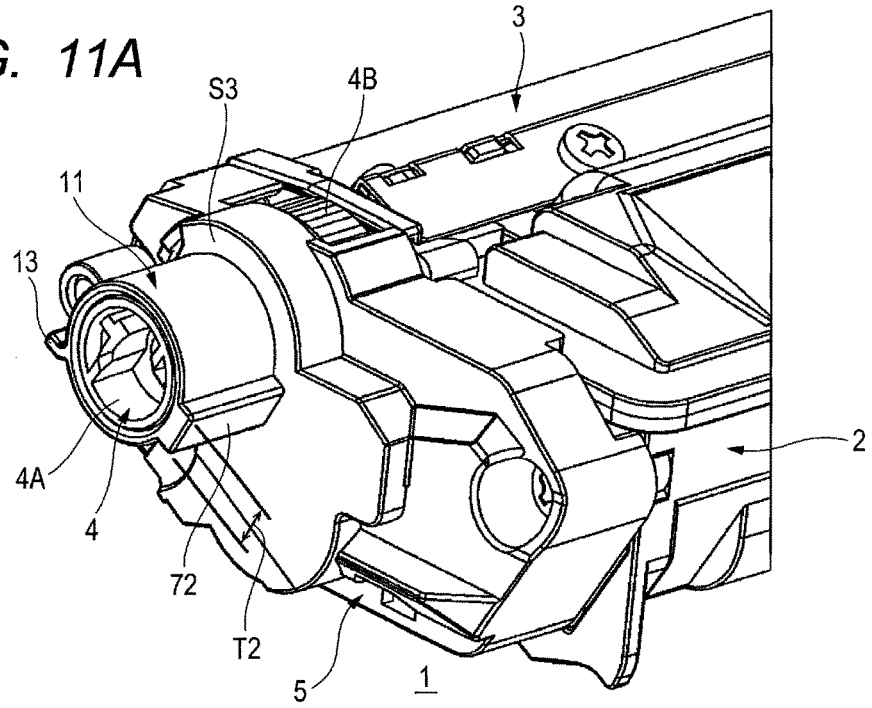
FIGS. 11A and 11B are explanatory diagrams for illustrating modifications of a first protruding portion.

As shown in FIG. 11A, the first protruding portion 72 may extend in the rotational direction of the coupling 4. The length T2 of the first protruding portion 72 in the rotational direction of the coupling 4 is longer than the length T1 of the first protruding portion 12 in the above-described embodiment. The length T2 is specifically 5 mm, for example.

Figure 11B:
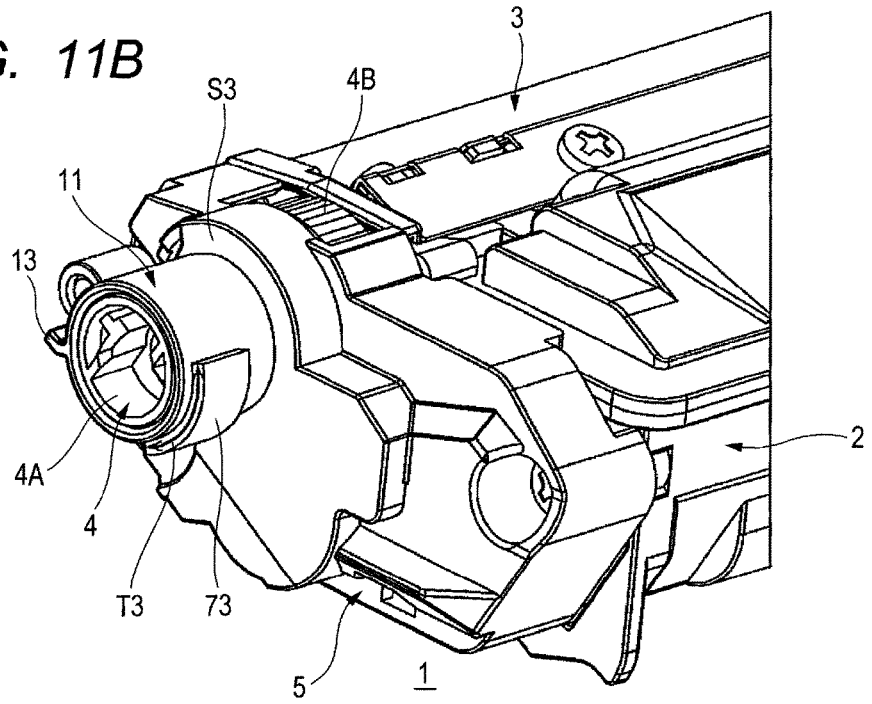

As shown in FIG. 11B, the first protruding portion 73 may be formed as a separate member from the first cover portion 11 and be attached to the circumferential surface of the first cover portion 11. In this case, the first protruding portion 73 may be a plate that is curved along the circumferential surface of the first cover portion 11, or may be rubber that can curve along the circumferential surface of the first cover portion 11. The length T3 of the first protruding portion 73 in the rotational direction of the coupling 4 is longer than the length T1, T2 of the first protruding portion 12, 72 in the above-described embodiment and modification. The length T3 is specifically 15 mm, for example.

Figure 12A:
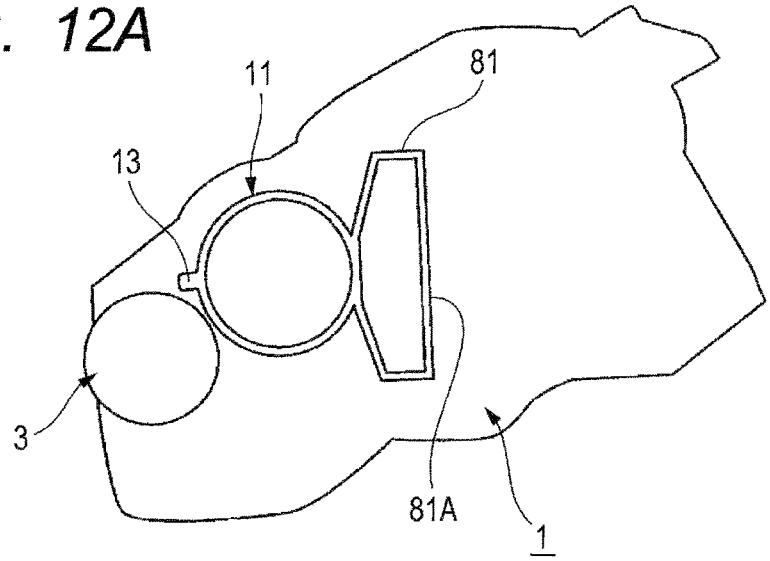
FIG. 12A is an explanatory diagram for illustrating a modification of a first protruding portion.

As shown in FIG. 12A, a first protruding portion 81 may have a flat surface 81A extending in a radial direction of the coupling 4. In this case, the length of the first protruding portion 81 in the radial direction of the coupling 4 is specifically 25 mm, for example. Since the flat surface 81A extends in the radial direction of the coupling 4, pressing force can be received more stably, compared with a case where the first protruding portion 73 is curved as in the modification shown in FIG. 11B.

Figure 12B:
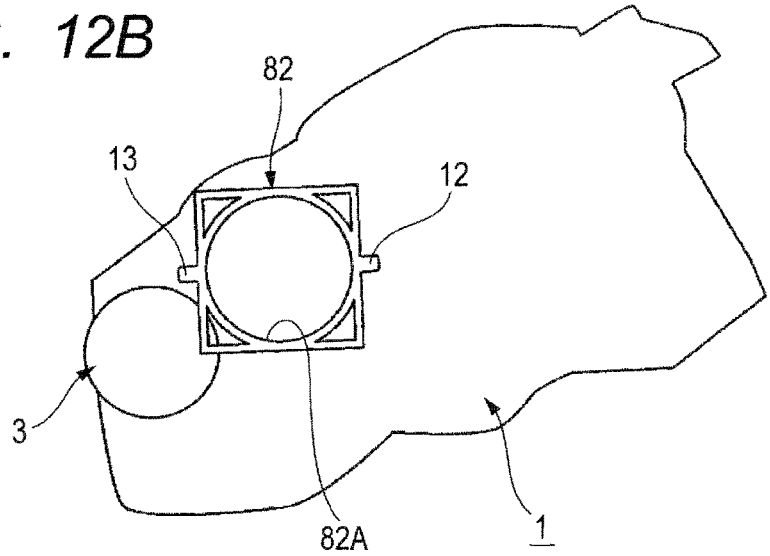
FIG. 12B is an explanatory diagram for illustrating a modification of a first cover portion.

Further, the shape of the first cover portion is not limited to a cylindrical shape. For example, as shown in FIG. 12B, the first cover portion 82 may be a rectangular tubular shape having a hole 82A in which the joint 4A fits.

What is claimed is:

1. A developing cartridge comprising:

a developing roller configured to be rotatable about a first axis extending in a first direction;

a frame configured to accommodate developer, the frame having a one end portion and an other end portion away from the one end portion in a second direction intersecting the first direction, the frame having a first outer surface and a second outer surface at both ends of the frame in the first direction, the second outer surface being located at an opposite side from the first outer surface in the first direction;

a coupling configured to be rotatable about a second axis extending in the first direction, the coupling being located at the first outer surface, the coupling having a joint extending in the first direction, the coupling having a coupling gear that rotates together with the joint;

a first gear cover configured to cover at least part of the coupling gear, the first gear cover being located at the first outer surface, the first gear cover having a third outer surface that is located at an opposite side from the first outer surface with respect to the coupling gear in the first direction, the first gear cover having a first cover portion that covers an outer peripheral surface of the joint and that protrudes from the third outer surface in the first direction;

a gear configured to be rotatable about a third axis extending in the first direction by receiving driving force transmitted from the coupling, the gear being located at the second outer surface;

a second gear cover configured to cover at least part of the gear, the second gear cover having a second cover portion protruding in the first direction, the second gear cover being located at the second outer surface;

a first protruding portion protruding from the first cover portion in the second direction, the first protruding portion being located at an opposite side from the developing roller with respect to the joint in the second direction, the first protruding portion having a first base end connecting to the first cover portion and a first tip end that is farthest away from the first base end;

a second protruding portion protruding from the second cover portion in the second direction, the second protruding portion being located at a same position as the first protruding portion in the second direction; and a third protruding portion protruding from the first cover portion in the second direction, the third protruding portion being located at an opposite side from the first protruding portion with respect to the joint in the second direction, the third protruding portion having a second base end connecting to the first cover portion and a second tip end that is farthest away from the second base end such that a length of the first protruding portion from the first base end to the first tip end is shorter than a length of the third protruding portion from the second base end to the second tip end.

2. The developing cartridge according to claim 1, wherein the one end portion of the frame is an end portion at which the developing roller is provided, and the other end portion of the frame is an end portion opposite from the one end portion; and wherein the first protruding portion and the second protruding portion are located at a position closer to the developing roller than the other end portion of the frame is in the second direction.

3. The developing cartridge according to claim 1, further comprising:

a fourth protruding portion protruding from the second cover portion in the second direction, the fourth protruding portion being located at a same position as the third protruding portion in the second direction.

4. The developing cartridge according to claim 3, wherein the third protruding portion extends from the first gear cover; and wherein the fourth protruding portion extends from the second gear cover.

5. The developing cartridge according to claim 3, wherein the third protruding portion is attached to the first gear cover; and wherein the fourth protruding portion is attached to the second gear cover.

6. The developing cartridge according to claim 3, wherein the second direction is a direction connecting the first axis with the second axis; and wherein the first protruding portion is located at an opposite side from the third protruding portion with respect to the second axis in the second direction.

7. The developing cartridge according to claim 3, wherein the first protruding portion has a first base end connecting to the first cover portion and a first tip end that is farthest away from the first base end;

wherein the third protruding portion has a second base end connecting to the first cover portion and a second tip end that is farthest away from the second base end; and wherein a first imaginary line connecting the first tip end of the first protruding portion with the second axis and a second imaginary line connecting the second tip end of the third protruding portion with the second axis form an angle larger than or equal to 90 degrees and smaller than or equal to 80 degrees.

8. The developing cartridge according to claim 7, wherein the first imaginary line and the second imaginary line form an angle larger than or equal to 115 degrees and smaller than or equal to 145 degrees.

9. The developing cartridge according to claim 1, wherein the first protruding portion extends from the first gear cover; and wherein the second protruding portion extends from the second gear cover.

10. The developing cartridge according to claim 1, wherein the first protruding portion is attached to the first gear cover; and wherein the second protruding portion is attached to the second gear cover.

11. The developing cartridge according to claim 1, wherein the first protruding portion is aligned with the coupling gear in the first direction.

12. The developing cartridge according to claim 1, further comprising a protrusion configured to rotate about the third axis together with the gear.

13. The developing cartridge according to claim 12, wherein the gear comprises a detection gear configured to, when the developing cartridge is mounted on an image forming apparatus, rotate by receiving driving force transmitted from the coupling thereby rotating the protrusion; and wherein, when the protrusion rotates together with the detection gear, the protrusion is detected by the image forming apparatus.

14. The developing cartridge according to claim 1, wherein the first cover portion has a cylindrical shape.

15. The developing cartridge according to claim 1, wherein the second cover portion covers an outer peripheral surface of the gear.

16. The developing cartridge according to claim 1, wherein the second cover portion has a cylindrical shape.

17. The developing cartridge according to claim 1, wherein a length of the first protruding portion in a rotational direction of the coupling is larger than or equal to 1.0 mm and smaller than or equal to 25.0 mm.

18. The developing cartridge according to claim 17, wherein the length of the first protruding portion in the rotational direction of the coupling is larger than or equal to 1.5 mm and smaller than or equal to 20.0 mm.

19. A developing cartridge comprising:

a developing roller configured to be rotatable about a first axis extending in a first direction, the developing cartridge configured to be detachably mounted on a drum cartridge having a photosensitive drum;

a frame configured to accommodate developer, the frame having a one end portion and an other end portion away from the one end portion in a second direction intersecting the first direction, the frame having a first outer surface and a second outer surface at both ends of the frame in the first direction, the second outer surface being located at an opposite side from the first outer surface in the first direction;

a coupling configured to be rotatable about a second axis extending in the first direction, the coupling being located at the first outer surface, the coupling having a joint extending in the first direction, the coupling having a coupling gear that rotates together with the joint;

a first gear cover configured to cover at least part of the coupling gear, the first gear cover being located at the first outer surface, the first gear cover having a third outer surface that is located at an opposite side from the first outer surface with respect to the coupling gear in the first direction, the first gear cover having a first cover portion that covers an outer peripheral surface of the joint and that protrudes from the third outer surface in the first direction;

a gear configured to be rotatable about a third axis extending in the first direction by receiving driving force transmitted from the coupling, the gear being located at the second outer surface;

a second gear cover configured to cover at least part of the gear, the second gear cover having a second cover portion protruding in the first direction, the second gear cover being located at the second outer surface;

a first protruding portion protruding from the first cover portion in the second direction, the first protruding portion being located at an opposite side from the developing roller with respect to the joint in the second direction such that the first protruding portion receives, from one pressing member of the drum cartridge, pressing force in a direction from the developing roller toward the photosensitive drum; and a second protruding portion protruding from the second cover portion in the second direction, the second protruding portion being located at a same position as the first protruding portion in the second direction such that the second protruding portion receives, from another pressing member of the drum cartridge, pressing force in the direction from the developing roller toward the photosensitive drum.

* * * * *